US011787597B2

(12) United States Patent
Stengel, Jr. et al.

(10) Patent No.: US 11,787,597 B2
(45) Date of Patent: Oct. 17, 2023

(54) RESEALABLE POP TOP LID

(71) Applicants: Gilbert P. Stengel, Jr., Burlington, KY (US); Tracey Martinez, Waynesville, OH (US)

(72) Inventors: Gilbert P. Stengel, Jr., Burlington, KY (US); Tracey Martinez, Waynesville, OH (US)

( * ) Notice: Subject to any disclaimer, the term of this patent is extended or adjusted under 35 U.S.C. 154(b) by 0 days.

(21) Appl. No.: 17/811,544

(22) Filed: Jul. 8, 2022

(65) Prior Publication Data

US 2022/0396394 A1 Dec. 15, 2022

Related U.S. Application Data

(63) Continuation-in-part of application No. 16/799,342, filed on Feb. 24, 2020, now abandoned.

(60) Provisional application No. 62/810,355, filed on Feb. 25, 2019.

(51) Int. Cl.

| | |
|---|---|
| ***B65D 17/40*** | (2006.01) |
| ***B65D 17/28*** | (2006.01) |
| ***B65D 17/00*** | (2006.01) |

(52) U.S. Cl.

CPC ..... *B65D 17/4014* (2018.01); *B65D 17/02* (2013.01); *B65D 2517/0032* (2013.01)

(58) Field of Classification Search

CPC ..... B65D 17/4014; B65D 17/4012; B65D 17/401; B65D 17/02; B65D 17/521; B65D 17/52; B65D 51/18; B65D 51/226; B65D 47/265; B65D 47/261; B65D 47/26

USPC ..... 220/254.4, 254.3, 254.1, 253, 259.4, 220/259.3, 256.1, 278, 277, 265, 730, 220/272, 273, 270, 266, 267; 81/3.55, 81/3.57, 3.15, 3.09

See application file for complete search history.

(56) References Cited

U.S. PATENT DOCUMENTS

| | | | | |
|---|---|---|---|---|
| 3,888,384 | A * | 6/1975 | Novak | B65D 17/4012 220/268 |
| 3,970,212 | A * | 7/1976 | Brown | B65D 17/4012 220/361 |
| 4,141,464 | A * | 2/1979 | Kelley | B65D 17/4012 220/267 |
| 8,870,012 | B2 * | 10/2014 | Stengel, Jr. | B65D 17/4012 220/272 |
| 2010/0294768 | A1 * | 11/2010 | Ramsey | B65D 17/4014 220/240 |
| 2019/0112112 | A1 * | 4/2019 | Choltco-Devlin | B65D 47/265 |
| 2019/0337687 | A1 * | 11/2019 | Kleiner | B65D 47/20 |

(Continued)

*Primary Examiner* — Robert J Hicks

(74) *Attorney, Agent, or Firm* — Jenei LLC

(57) ABSTRACT

A pop top lid enables opening and closing of a top opening in a cylindrical fluid container such as a beverage can. an enclosing a top opening in a cylindrical fluid container. A pocketed tang of a stay-on tab assembly pivots about a central rivet on an end shell of the pop top lid. During lifting and rotation of the stay-on tab assembly, an aperture creation point begins to shear a scored line to remove a tear panel from an end shell of the beverage can. directing the tear panel between a top cover and a bottom plate of the pocketed tang. A flange of the bottom plate assists in removal of the tear panel by being directed into a panel opening left by the tear panel directing the tear panel into the tear panel capturing pocket when the stay-on-tab assembly is rotated in a first direction of rotation.

8 Claims, 10 Drawing Sheets

(56) References Cited

U.S. PATENT DOCUMENTS

2020/0039700 A1* 2/2020 Coffey ..... B65D 51/1688

* cited by examiner

RESEALABLE POP TOP LID

CROSS-REFERENCE TO RELATED APPLICATIONS

This application is a continuation-in-part of U.S. patent application Ser. No. 16/799,342 entitled "RESEALABLE POP TOP LID", filed Feb. 24, 2020, which in turn claims the benefit of priority under 35 U.S.C. § 119(e) to U.S. Patent Application Provisional Application Ser. No. 62/810,355 entitled "RESEALABLE POP TOP LID", filed Feb. 25, 2019, the contents of both of which are hereby incorporated by reference in their entirety for any purpose.

FIELD OF THE INVENTION

The present disclosure generally relates to sealed metal containers, and more specifically to sealed metal containers have a pop top actuator for unsealing an opening.

BACKGROUND OF THE INVENTION

Beverage cans continue to a very popular and effective way to preserve, transport, and consume liquids. Aluminum foil formed into beverage cans provides a safe and recyclable material that preserves the liquid contents. To avoid litter and choking hazards, removable pull tabs have largely been replaced by pull tabs that are retained on an end shell of the beverage can. Given the short amount of leverage afforded by the generally known pull tabs, many consumers have to rely on a tool to pry up the pull tab and to provide additional leverage. Often the mechanical strength of the pull tab itself is insufficient to sufficiently shear a scored line on the pop top lid to create an opening for pouring the liquid contents.

BRIEF DESCRIPTION OF DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
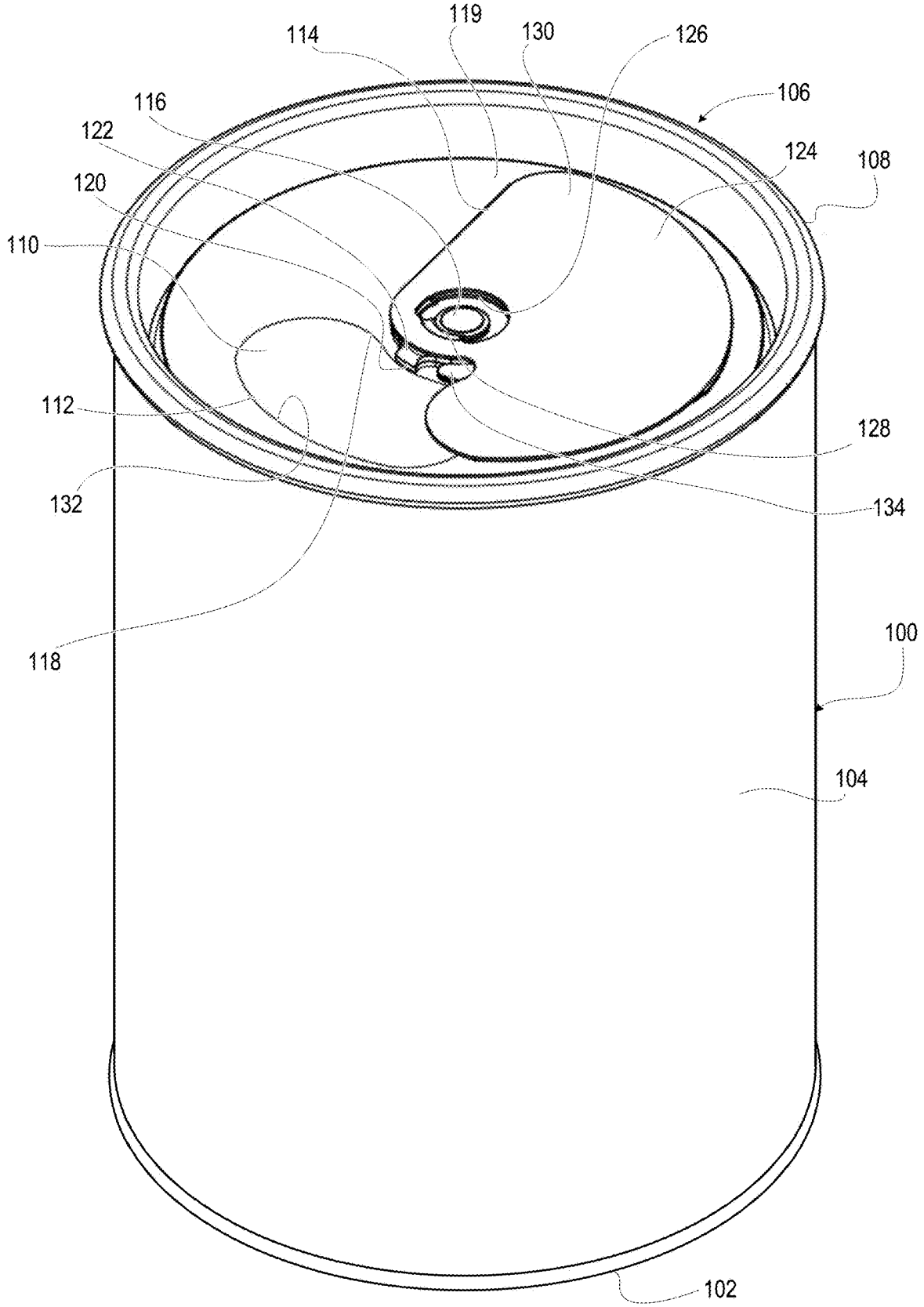
FIG. 1 is an isometric top view illustrating a sealed can having pop top lid, according to one or more embodiments.

According to aspects of the present innovation, a pop top lid enables opening and closing of a top opening in a cylindrical fluid container such as a beverage can. In one or more embodiments, the pop top lid includes an end shell having an off-center scored line defining a tear panel. The pop top lid includes a stay-on tab assembly. In one or more embodiments, the stay-on tab assembly comprises an enclosing a top opening in a cylindrical fluid container. The pop top lid includes an end shell having an off-center scored line defining a tear panel. The pop top lid includes a stay-on tab assembly attached by a rivet to the end shell for rotation. The stay-on tab assembly has a pocketed tang including a central portion having a pivot hole that receives the rivet and having a top cover and a bottom plate spaced by a gap on a leading edge. The gap communicates with a tear panel capturing pocket. The pocketed tang extends radially sufficiently to cover and seal the tear panel. An aperture point, opposite to the actuator portion, is attached to the pocketed tang and rotatably positionable proximate to an inner edge of the scored line. The pocketed tang is movable as an actuator portion liftable as a first-degree lever to form an aperture at the scored line with the aperture point. A flange of the bottom plate assists in removal of the tear panel by being directed into a panel opening left by the tear panel directing the tear panel into the tear panel capturing pocket when the stay-on-tab assembly is rotated in a first direction of rotation.

According to other aspects of the present innovation, a pop top lid encloses a top opening in a cylindrical fluid container. In one or more embodiments, the pop top lid includes an end shell having an off-center scored line defining a tear panel. The pop top lid includes a stay-on tab assembly. The pop top lid includes a rivet that attaches the stay-on tab assembly to the end shell for rotation. The stay-on tab assembly includes a central portion having a pivot hole that receives the rivet. The stay-on tab assembly includes an aperture point attached to the central portion and rotatably positionable proximate to an inner edge of the scored line. The stay-on tab assembly includes a shearing edge attached to the central portion and radially extending behind the aperture point in a first direction of rotation about the pivot hole. The stay-on tab assembly includes an actuator portion attached to the central portion opposite to the aperture point. The actuator portion is liftable as a first-degree lever to form an aperture at the scored line with the aperture point. The actuator portion is rotatable in the first direction of rotation to insert the shearing edge into the aperture shearing the scored line to remove the tear panel from the end shell.

In one or more embodiments, the pop top lid further includes: (i) a bottom plate comprising the aperture point and the shearing edge; (ii) a top cover comprising the actuator portion and an extending portion that is positioned over top of a portion of the score line to direct a sheared portion of the tear panel downward; and (iii) a tear panel capturing slot between the bottom plate and the top cover positioned to receive the sheared portion of the tear panel as directed by the extending portion of the top cover. In a particular embodiment, the pop top lid further includes a capturing pocket downwardly formed within the bottom plate within the tear panel capturing slot. The capturing pocket is sized to correspond to receive the tear panel, wherein an undersurface of the tear panel capturing slot comprises a reseal mating surface. The reseal mating surface is rotationally positionable by the top cover to reseal a panel opening formed in the end shell with removal of the tear panel.

In one or more embodiments, the pop top lid further includes an annular recess formed partially around the rivet hole in the central portion of top cover to define a pivot tab that is attached to the aperture point. The annular recess reduces force required to lift the actuator portion away from the end shell to allow finger actuation.

In one or more embodiments, the pop top lid further includes a flipped-up edge of the actuator portion to facilitate finger actuation of the stay-on tab assembly.

In the following detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized, and that logical, architectural, programmatic, mechanical, electrical, and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

FIG. 1 illustrates a sealed can 100 having a circular bottom 102, a cylindrical side wall 104, and a pop top lid 106. In one or more embodiments, sealed can 100 is formed of aluminum and is used to contain and dispense liquids or flowable solid granules. The pop top lid 106 consists of: (i) an end shell 108 having a tear panel 110 defined by a scored line 112; (ii) a stay-on tab assembly 114; and (iii) a rivet 116. The pop top lid 106 can conform to B64 can end standards. The stay-on tab assembly 114 is fixed to the end shell 108 by the rivet 116 at a center point of end shell 108 that allows rotational movement. An inward edge 118 of scored line 112 is radially spaced from the rivet 116 and corresponds to a tear panel shearing edge 120 extending from an aperture creation point 122 of a bottom plate 134 mostly hidden below a top cover 124 of the stay-on tab assembly 114. Proximate to the aperture creation point 122, a three-quarter annular aperture 126 formed through the top cover 124 at a center portion 127, defining a rivet tab 128 that receives rivet 116 and provides a fulcrum-to-load portion of a class 1 lever. A liftable actuator portion 130 at a trailing, counter-clockwise side of top cover 124 extends close to an opposite edge of pop top lid 106 relative to tear panel 110 and provides a fulcrum-to-effort portion of the class 1 lever. The three-quarter annular aperture 126 enables an initial upward tilt of the liftable actuator portion 130 to be accomplished with minimal force to initiate shearing of the scored line 112. As will discussed herein, with subsequent clockwise rotation, the stay-on tab assembly 114 shears the tear panel 110 away from a flat circular top disk surface 119 at the scored line 112 for exposing a panel opening 132. Simultaneously, the stay-on tab assembly 114 captures the removed tear panel 110. With further rotation, the stay-on tab assembly 114 selectably reseals and unseals the panel opening 132.

Figure 2:
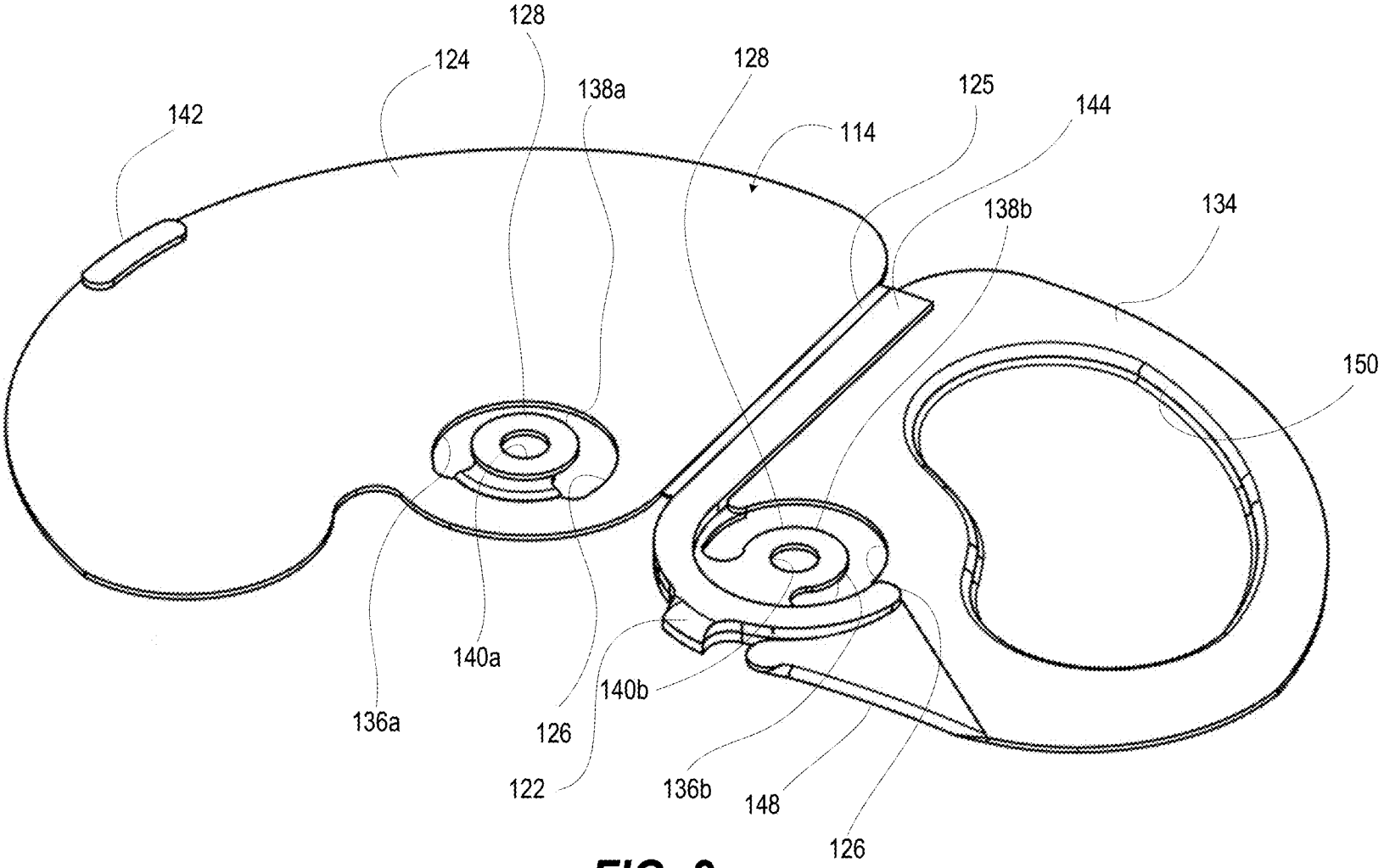
FIG. 2 is an isometric top view of a stay-on tab assembly of the pop top lid of FIG. 1 with a top cover flipped over to expose a hingedly attached bottom plate, according to one or more embodiments.
Figure 3:
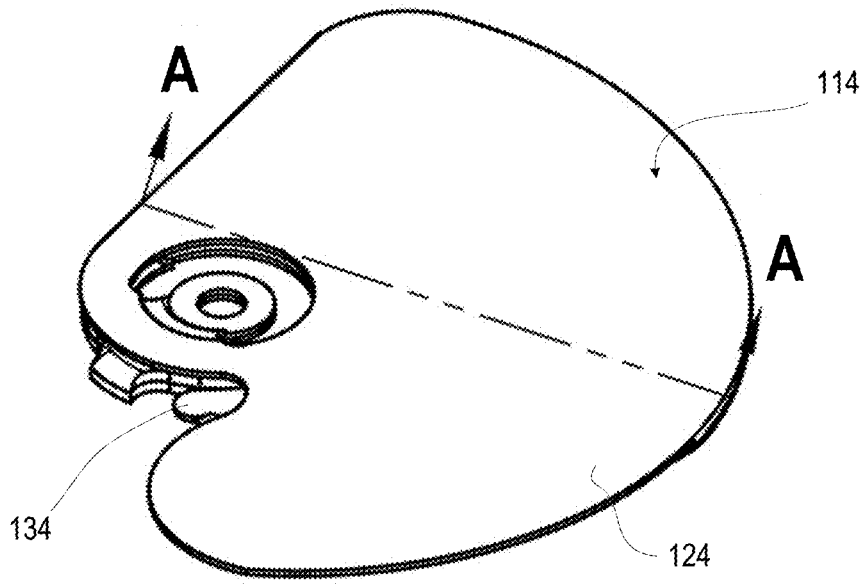
FIG. 3 is an isometric top view of the stay-on tab assembly of FIG. 2 with the top cover positioned over the bottom plate, according to one or more embodiments.
Figure 4:
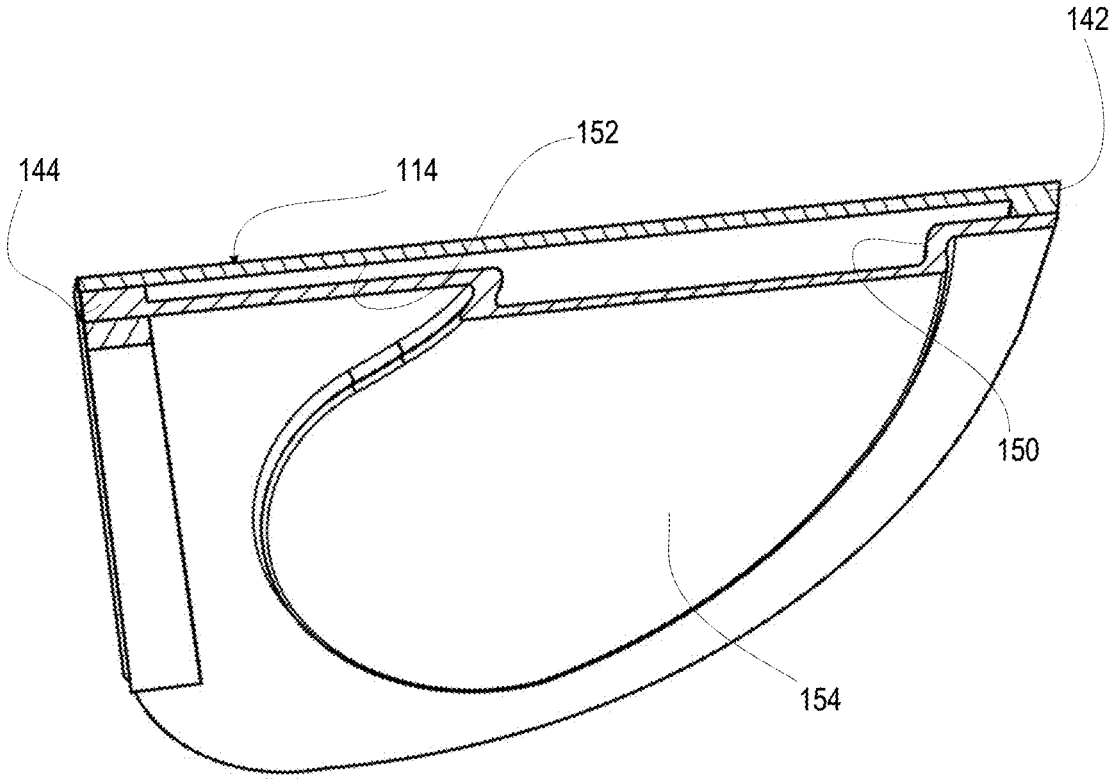
FIG. 4 is an isometric top view of the stay-on tab assembly of FIG. 3 cutaway along lines A-A, according to one or more embodiments.

FIG. 2 illustrates the stay-on tab assembly 114 of the pop top lid 106 (FIG. 1) with the top cover 124 flipped over to expose an attachment by a hinge 125 to a bottom plate 134 in an unfolded position. The hinge 125 can be a transverse area of thin metal that is readily deformable into a fold. FIG. 3 illustrates the stay-on tab assembly 114 with the top cover 124 positioned over the bottom plate 134 in a folded position. Returning to FIG. 2, top cover 124 and bottom plate 134 contribute respectively upper and lower portions 136*a*, 136*b* of three-quarter annular aperture 126 that align when in a folded position in FIG. 3. Top cover 124 and bottom plate 134 contribute respectively as well as upper and lower portions 138*a*, 138*b* of rivet tab 128 having respective rivet holes 140*a*, 140*b* that align when in the folded position in FIG. 3. An outer spacer 142 is attached on an underside of the top cover 124 and an inner spacer 144 is attached to an upper surface of the bottom plate 134. The inner spacer 144 provides about 0.32" thickness of the bottom plate 134 for stiffness along the hinge 125 between the top cover 124 and the bottom plate 134 and a semicircle between the aperture creation point 122 and the rivet 116 (FIG. 1). A tear panel shearing edge 148 extends behind aperture creation point 122, both of which are part of bottom plate 134. Tear panel shearing edge 148 is knife edged and ramps up to a general thickness of the bottom plate 134, which in an exemplary embodiment is about 0.010". The bottom plate 134 is downwardly embossed to create a tear panel capturing pocket 150 sized to receive the tear panel 110 (FIG. 1) after removal. FIG. 4 illustrates the stay-on tab assembly 114 of FIG. 3 cutaway along lines A-A. The outer and inner spacers 142, 144 maintain a tear panel capture slot 152 dimensioned to receive the tear panel 110 (FIG. 1) during removal and to direct the tear panel 110 to the tear panel capturing pocket 150. A reseal mating surface 154 on a lower surface corresponds to the tear panel capturing pocket 150 on the upper side.

Figure 5:
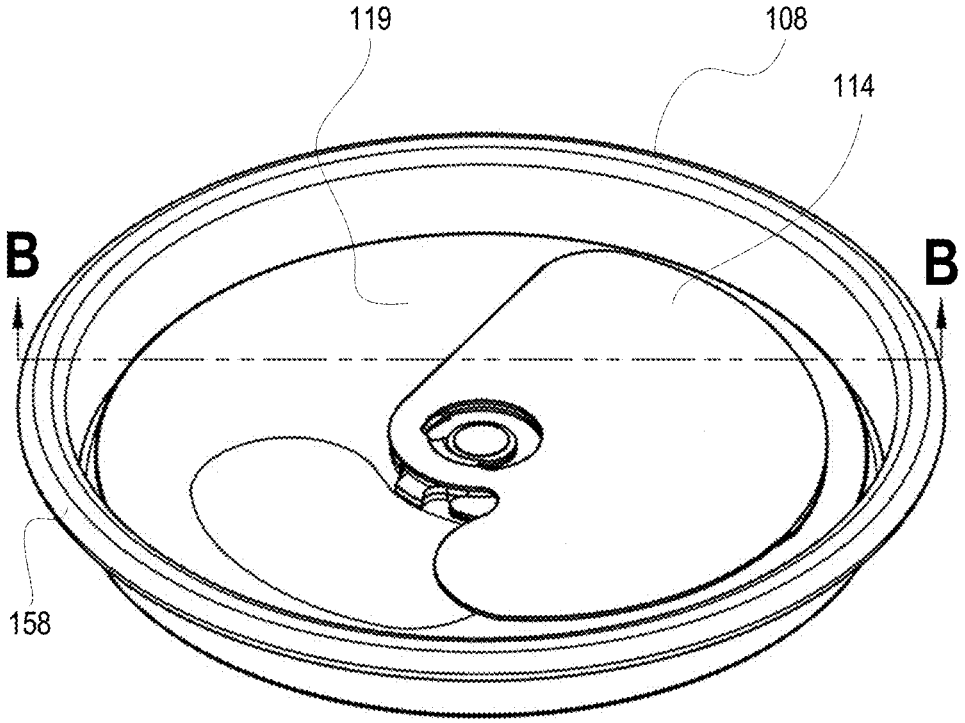
FIG. 5 is an isometric top right view of the pop top lid of FIG. 1, according to one or more embodiments.
Figure 6:
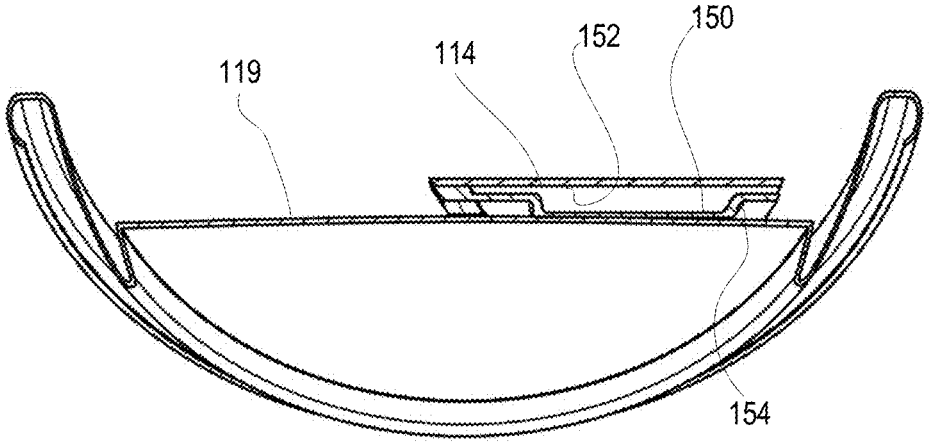
FIG. 6 is a side view of the pop top lid of FIG. 5 in cross section along lines B-B, according to one or more embodiments.

FIG. 5 illustrates that the end shell 108 presents a flat circular disk surface 119 inside of top ring 158 of pop top lid 106. The stay-on tab assembly 114 is dimensioned to rotate on the flat circular top disk surface 119. In one embodiment, the stay-on tab assembly 114 is dimensioned to rotate 360° on the flat circular top disk surface 119. FIG. 6 illustrates that a reseal mating surface 154 of stay-on tab assembly 114 slides against the flat circular top disk surface 119 when not aligned with reseal panel opening 132 (FIG. 1). The reseal mating surface 154 corresponds to the tear panel capturing pocket 150 on the upper side. The tear panel capture slot 152 passes under the top cover 124 and above the tear panel capturing pocket 150.

Figure 7:
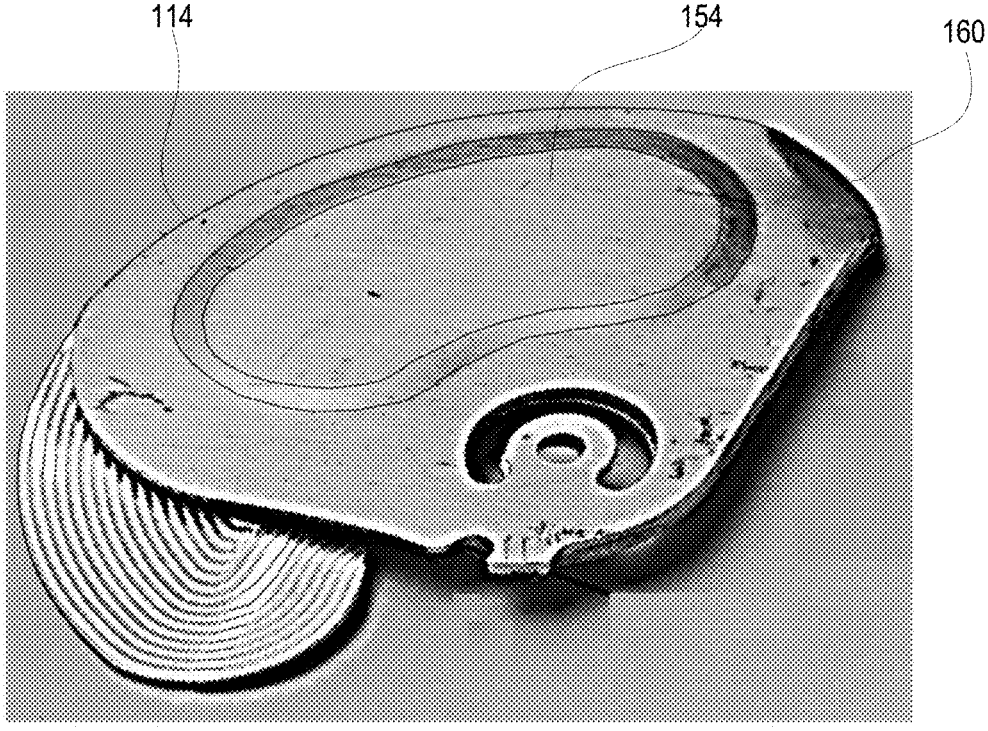
FIG. 7 is an isometric bottom view of a prototype stay-on tab assembly, according to one or more embodiments.
Figure 8:
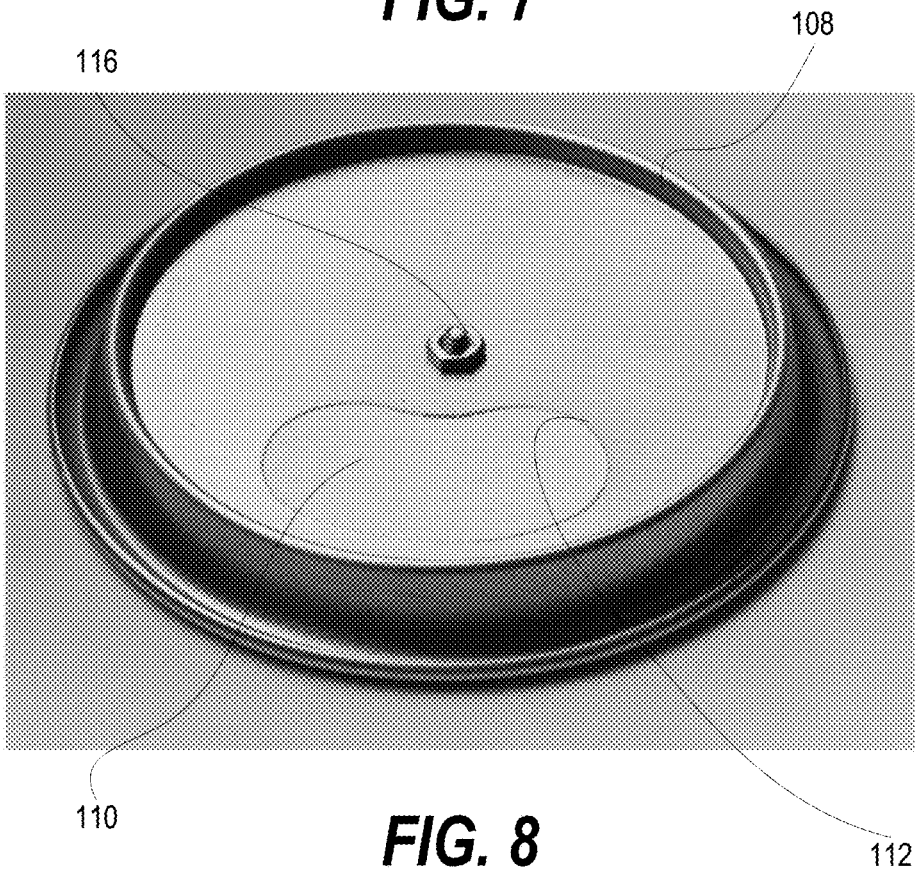
FIG. 8 is an isometric bottom view of an end shell of a prototype pop top lid, according to one or more embodiments.
Figure 14:
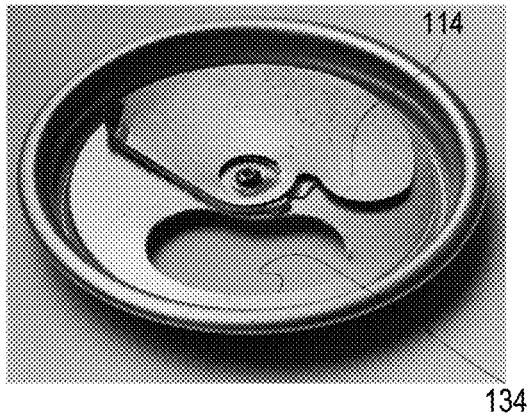
FIG. 14 is an isometric top view of the prototype pop top lid after rotating the stay-on tab assembly of FIG. 13A in either direction by 180° to unseal and expose the panel opening, according to one or more embodiments.

FIG. 7 illustrates the bottom side of a prototype stay-on tab assembly 114, exposing a reseal mating surface 154, which, when aligned in the bottom plate 134 (FIG. 1) reseals panel opening 132 (FIG. 14). FIG. 8 illustrates the bottom side of the end shell 108 having the scored line 112 etched into flat circular top disk surface 119 to define the tear panel 110 and having a center fastener such as a rivet 116 installed for receiving the stay-on tab assembly 114 (FIG. 7).

This disclosed prototype embodiment is an aluminum stay-on tab device designed to remove a tear panel access to a beverage container and rotate a resealable mating face into the opening left behind by removing the tear panel. This design exists on the top surface of a standard beverage can end shell, is held in place and actuates around a centrally placed standard rivet, utilizes a standard industry scored tear panel and is constructed of 0.010" foil. The entire device can be constructed to be not taller than 0.050" in height and operates with very low forces. The stay-on tab assembly is a folded design that when rotated, completely removes a scored tear panel and encases that panel in a pocket between two layers of 0.010" aluminum.

This disclosed prototype embodiment is a proof-of-concept model of the disclosed innovation. The tab assembly was computer numerical control (CNC) milled from aluminum sheet stock and attached to a B64 end shell. The score shape was modeled by engraving a line directly on an end shell. The tab bottom plate was embossed to represent the reseal face of the design, however, the embossed face shown here does not have an undercut draft that would allow this face to mate with the opening in such a way that with the proper plastic coating the reseal function could be rendered gas tight. The model disclosed here is not meant to be exclusionary, simply demonstrative. The proof-of-concept model was milled from 0.040" aluminum for the bottom plate, and 0.016" aluminum for the top cover. A small machine screw mimics the rivet, and the tear panel is defined by an engraved line directly in the B64 end shell to mimic a scored panel. The bottom plate of the assembly was embossed in order to visually define the reseal mating face, though this embossing does not contain any draft to facilitate this face "snapping" into the open tear panel.

Figure 9A:
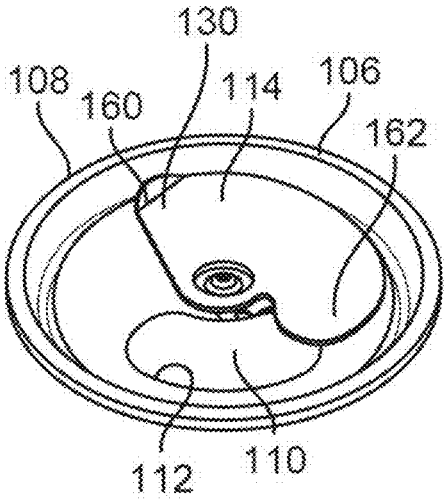
FIG. 9A is an isometric top view of the prototype pop top lid of FIG. 8 after tilting a liftable actuator portion of the top cover of the stay-on tab assembly to begin an initial shear of the scored line around a tear panel, according to one or more embodiments.
Figure 9B:
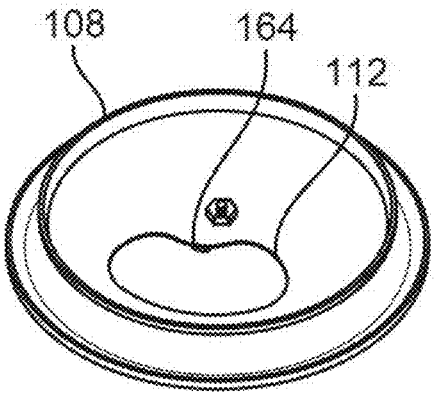
FIG. 9B is an isometric bottom view of the prototype pop top lid of FIG. 9A, according to one or more embodiments.

FIGS. 9A-14 illustrate sequence of operation of the stay-on tab assembly 114. FIG. 9A illustrates the prototype pop top lid 106 after tilting the liftable actuator portion 130. A counterclockwise edge of the top cover 124 is turned upward to present a first thumb pull area 160. A clockwise edge of the top cover 124 extends beyond the bottom plate 134 and is upwardly turned, providing a second thumb pull area 162. Either thumb pull area 160, 162 can be actuated to lift and to rotate the stay-on tab assembly 114 to begin an initial shear of the scored line 112 around the tear panel 110. FIG. 9B illustrates a panel opening 164 formed in the scored line 112. In one or more embodiments, initial aperture creation occurs from lifting the first thumb pull area 160 upwards about 20° from horizontal. The actual aperture only needs to be 0.015" or so in height, and very little force is needed to accomplish this. Once the aperture is created the rest of the movement is rotational, in plane with the flat circular top disk surface 119 of the end shell 108. With further reference to FIG. 9B, initial rotation of the tear panel removal edge 148 into panel opening 164 is shown. Once this removal edge 148 enters the aperture 164, the tear panel 110 is only able to enter the capture slot 152 (FIG. 2) in the stay-on tab assembly 114. The top cover 124 holds down the rising edge of the tear panel 110, ensuring that the only direction for continued travel results for the tear panel 110 is entering the capture slot 152.

Figure 10A:
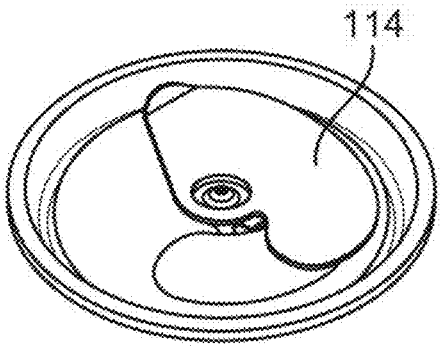
FIG. 10A is an isometric top view of the prototype pop top lid of FIG. 8 after a first amount of rotating the stay-on tab assembly to move a tear shearing edge of an aperture creation point into an aperture opening and under tear panel, according to one or more embodiments.
Figure 10B:
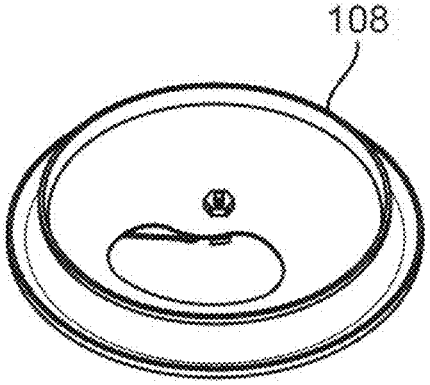
FIG. 10B is an isometric bottom view of the prototype pop top lid of FIG. 10A with tear panel removal edge of bottom plate in view under tear panel, according to one or more embodiments.

FIGS. 10A-10B illustrate the stay-on tab assembly 114 after a first amount of rotating the stay-on tab assembly to move a tear shearing edge of an aperture creation point into an aperture opening and under tear panel. FIG. 10B illustrates a tear panel removal edge of bottom plate in view under tear panel. In an exemplary embodiment, the tear panel enters the void between the two layers of the tab assembly 114. This void has no dimension. the two layers of the tab assembly can touch each other. The only area that needs space is the initial capture slot next to the tear panel removal edge. The void between top and bottom halves of the tab assembly operates better if those two faces are touching, as this friction will grip the scored tear panel is it is leaving the end shell. This also allows for the entire tab assembly to be formed within an appropriate stacking space, even with the reseal face in place.

Figure 11A:
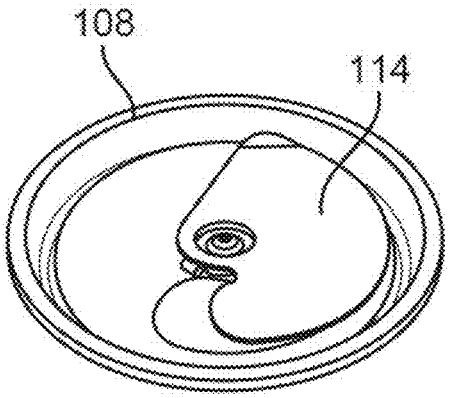
FIG. 11A is an isometric top view of the prototype pop top lid of FIG. 8 after an additional second amount of rotation of the stay-on tab assembly to complete shearing of inner radius of the scored line by the tear shearing edge of the aperture creation point, according to one or more embodiments.
Figure 11B:
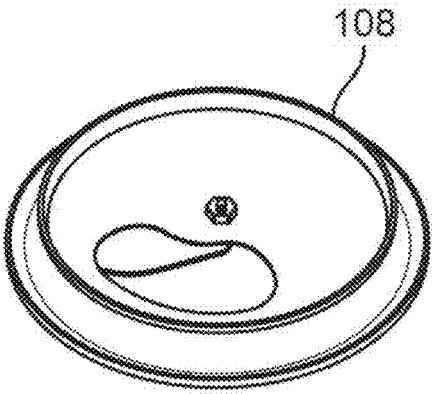
FIG. 11B is an isometric bottom view of the prototype pop top lid of FIG. 11A, shows that the tear panel removal edge of bottom plate advances under tear panel to expose a reseal embossing surface that lifts the tear panel to further cause shearing from the end shell, according to one or more embodiments.
Figure 12A:
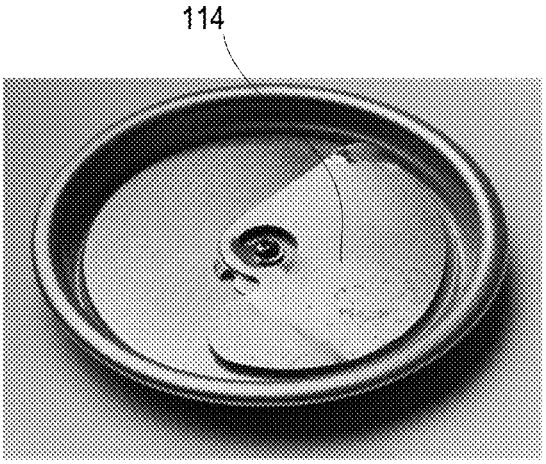
FIG. 12A is an isometric top view of the prototype pop top lid of FIG. 8 after a further third amount of rotating the stay-on tab assembly with the top cover positioned over the tear panel, according to one or more embodiments.
Figure 12B:
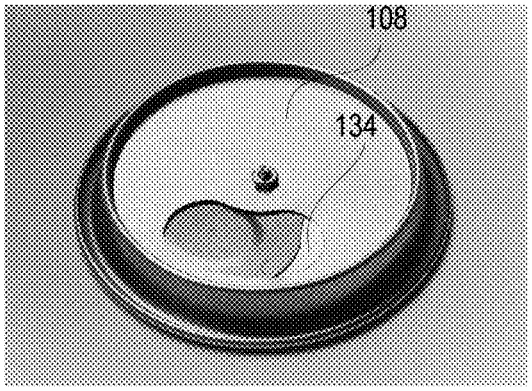
FIG. 12B is an isometric bottom view of the prototype pop top lid of FIG. 12A with tear panel removal edge of bottom plate advanced under most of tear panel, according to one or more embodiments.

FIGS. 11A-11B illustrate the stay-on tab assembly 114 of FIG. 8 after further rotating the stay-on tab assembly to complete shearing of inner radius of the scored line by the tear shearing edge of the aperture creation point. Score residuals will determine how far rotation can be completed while still forcing the tear panel into the capture slot. The top cover size and placement can be adjusted to account for how much of the tear panel is enclosed prior to complete fracture of the score. FIG. 11B illustrates tear panel shearing edge 148 of bottom plate 134 advanced under tear panel to expose a reseal embossing surface that lifts the tear panel to further cause shearing from the end shell. illustrates FIG. 12A illustrates the stay-on tab assembly 114 of FIG. 8 after a further third amount of rotating the stay-on tab assembly with the top cover positioned over the tear panel. FIG. 12B illustrates the stay-on tab assembly 114 of FIG. 12A with tear panel removal edge of bottom plate advanced under most of tear panel.

Figure 13A:
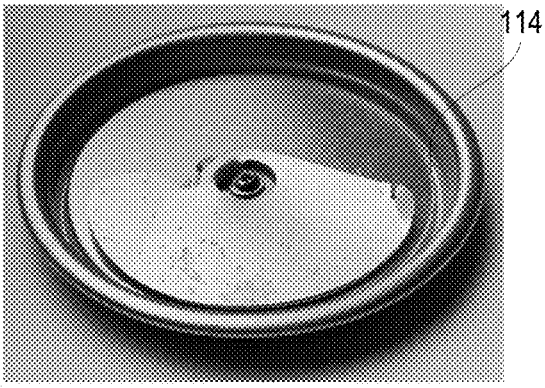
FIG. 13A is an isometric top view of the prototype pop top lid of FIG. 8 after a further fourth amount of rotating the stay-on tab assembly with the top cover positioned over the tear panel to a resealed position, according to one or more embodiments.
Figure 13B:
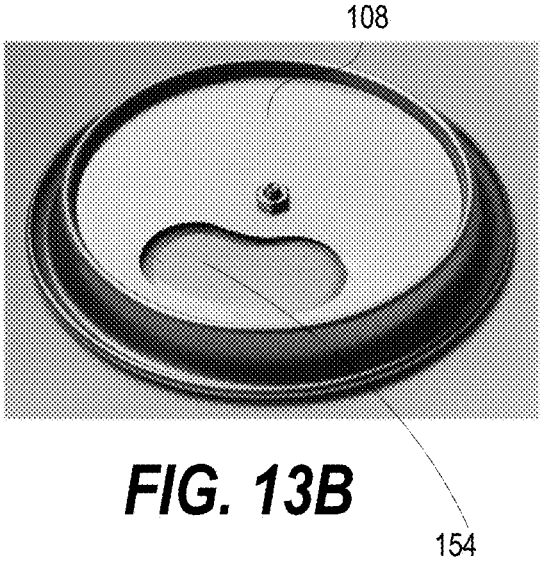
FIG. 13B is an isometric bottom view of the prototype pop top lid of FIG. 13A with tear panel removal edge of bottom plate advanced to position the reseal embossing surface in a panel opening exposed by removal of the tear panel, according to one or more embodiments.

FIG. 13A illustrates the stay-on tab assembly 114 of FIG. 8 after a further fourth amount of rotating the stay-on tab assembly with the top cover positioned over the tear panel to a resealed position. FIG. 13B illustrates the stay-on tab assembly 114 of FIG. 13A with tear panel removal edge of bottom plate advanced to position the reseal embossing surface in a panel opening exposed by removal of the tear panel.

FIG. 14 illustrates the stay-on tab assembly 114 of FIG. 8 after rotating the stay-on tab assembly of FIG. 13A in either direction by 180° to unseal the panel opening. To access the container contents, the reseal face is lifted approximately 0.025" above the end shell using the thumb pull areas and rotated away from the tear panel opening. The reseal face can be placed back into position or reopened as many times as needed.

For clarity, a clockwise moving stay-on tab assembly 114 is described herein. The components can be easily mirrored in design to operate in a counterclockwise direction within the scope of the present disclosure to achieve similar results. In an exemplary embodiment, a rotation of about 100° accomplishes the operation. In other embodiments, dimensions of the components can differ, resulting in more or less rotation to achieve unsealing and re-sealing.

Figure 15:
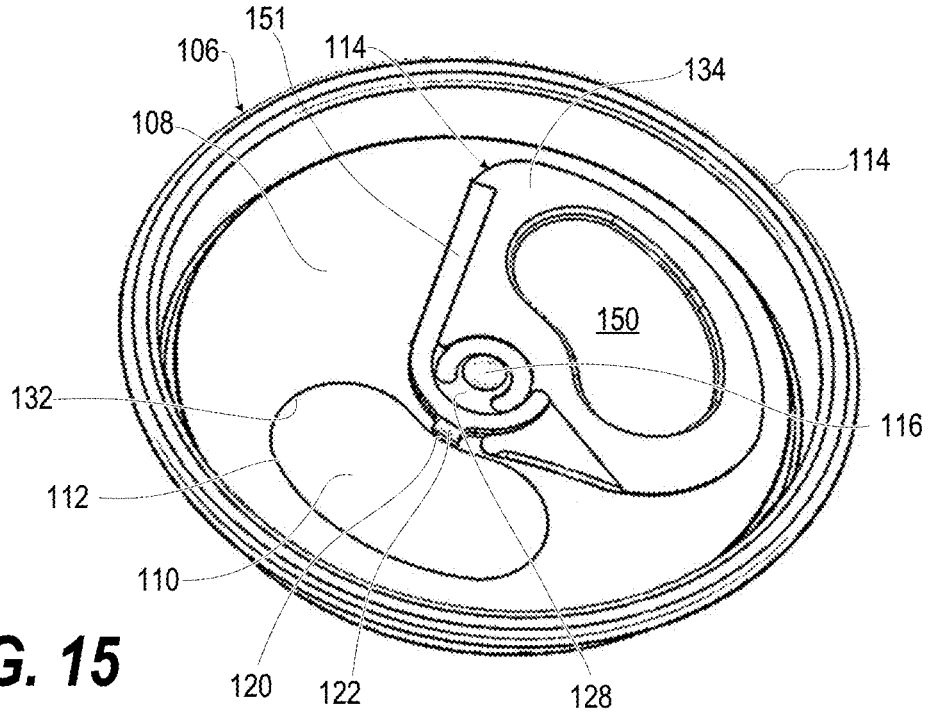
FIG. 15 illustrates a stay-on tab assembly of the pop top lid with the top cover removed, exposing the bottom plate that rotationally attached to the end shell of the pop top lid to engage, open, and seal the tear panel defined by the scored line, according to one or more embodiments.

FIG. 15 illustrates the stay-on tab assembly 114 of the pop top lid 106 with the top cover 124 (FIGS. 1-2) removed, exposing the bottom plate 134 that rotationally attached to the end shell 108 of the pop top lid 106 to engage, open, and seal the tear panel 110 defined by the scored line 112. The tear panel shearing edge 120 extending from an aperture creation point 122 of a bottom plate 134 sheers the scored line 112 to begin separating the tear panel 110. With continued rotation, the tear panel shearing edge 148 of the bottom plate 134 completes the separation of the tear panel 110. The bottom plate 134 is downwardly embossed to create a tear panel capturing pocket 150 sized to receive the tear panel 110 after removal. A stiffening rib 151 half encircles the rivet 116 on a side toward the aperture creation point 122. The stiffening rib 151 then extends along a trailing edge of the bottom plate 134.

Figure 16:
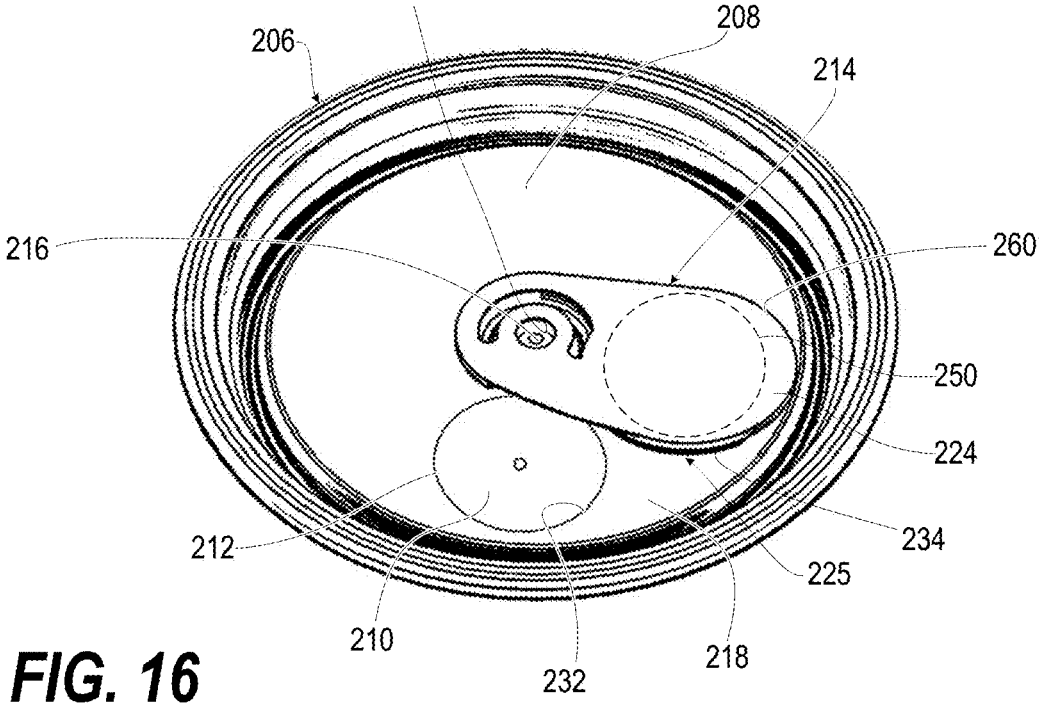
FIG. 16 illustrates a pop top lid having an end shell with a circular tear panel defined by a circular scored line, according to one or more embodiments.

FIG. 16 illustrates a pop top lid 206 having an end shell 208 with a circular tear panel 210 defined by a circular scored line 212. A stay-on tab assembly 214 is attached for rotation at a center point of the end shell 208 A top cover 224 of the stay-on tab assembly 214 includes a three-quarter annular aperture 226 formed through the top cover 224 at a center portion 227, defining a rivet tab 228 that receives rivet 216 and provides a fulcrum-to-load portion of a class 2 lever. A liftable actuator portion 230 at a trailing, counter-clockwise side of top cover 224 extends close to an opposite edge of pop top lid 206 relative to tear panel 210 and provides a fulcrum-to-effort portion of the class 2 lever. The three-quarter annular aperture 226 enables an initial upward tilt of the liftable actuator portion 230 to be accomplished with minimal force to initiate shearing of the scored line 212. As will discussed herein, with subsequent clockwise rotation, the stay-on tab assembly 214 shears the tear panel 210 away from a circular top surface 218 at the scored line 212 for exposing a panel opening 232. Simultaneously, the stay-on tab assembly 214 captures the removed tear panel 210. With further rotation, the stay-on tab assembly 214 selectably reseals and unseals the panel opening 232.

Figure 20:
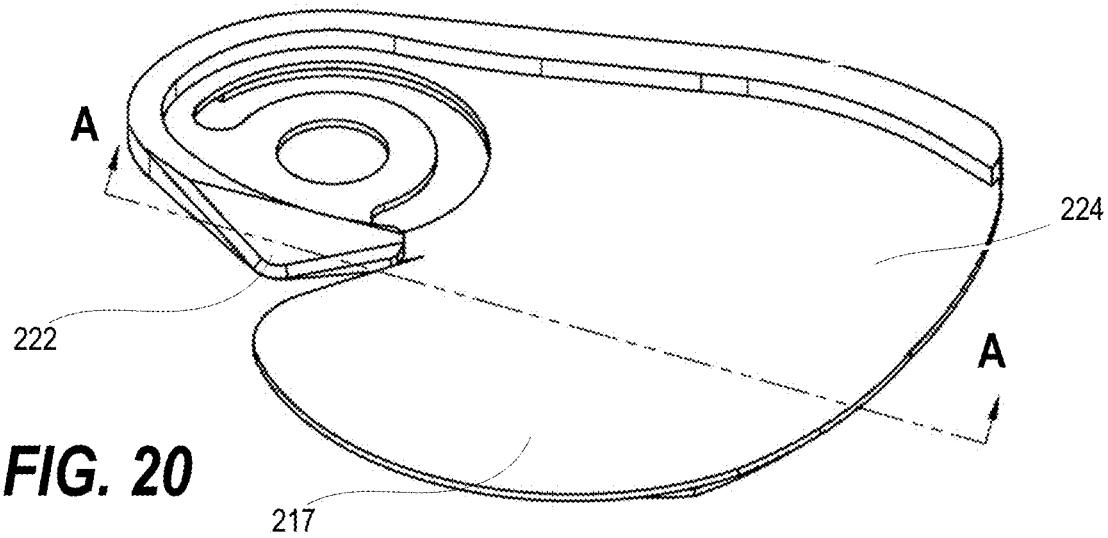
FIG. 20 is bottom three-dimensional view of the top cover, according to one or more embodiments.

In one or more embodiments, the pop top lid 206 enclosing a top opening in a cylindrical fluid container such as a beverage can. The top opening may be a circular panel opening 232. The pop top lid includes the end shell having the off-center circular scored line 210 defining the tear panel 212. The stay-on tab assembly 214 includes the rivet 216 that attaches the stay-on tab assembly to the end shell 208 for rotation. The stay-on tab assembly 214 includes a pocketed tang 260 comprising a central portion having a pivot hole 261 that receives the rivet 216 and having the top cover 124 and the bottom plate 134 spaced by the gap 225 on a leading edge. The gap 250 communicates with the tear panel capturing pocket 250. The pocketed tang 260 extending radially sufficiently to cover and seal the panel opening 232. The stay-on tab assembly 214 includes the aperture creation point 222 (FIG. 20) opposite to the liftable actuator portion 230, attached to the pocketed tang 260 and rotatably positionable proximate to an inner edge of the scored line, the pocketed tang movable as an actuator portion liftable as a first-degree lever to form an aperture 210 at the scored line 210 with the aperture creation point 222 (FIG. 20). A flange 217 (FIG. 20) of the bottom plate that assists in removal of the tear panel, directing the tear panel 212 into the tear panel capturing pocket 250, when the stay-on-tab assembly 214 is rotated in a first direction of rotation, the flange being directed into the panel opening 232 left by the tear panel 210.

Figure 17:
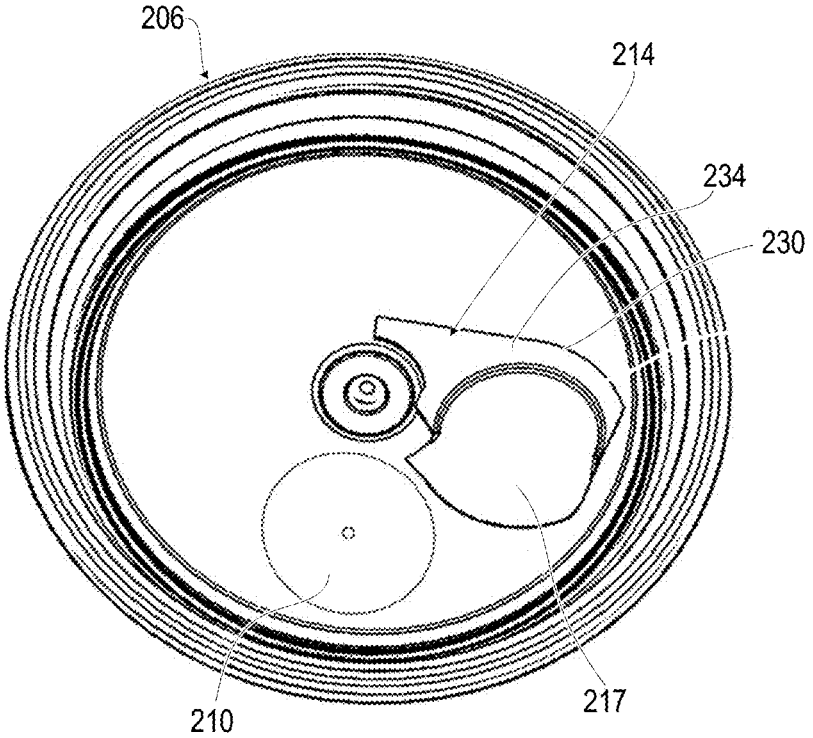
FIG. 17 is a top view of the pop top lid with the top cover of FIG. 16 removed to expose components of a bottom plate of the stay-on tab including a forward edge flange, according to one or more embodiments.
Figure 18:
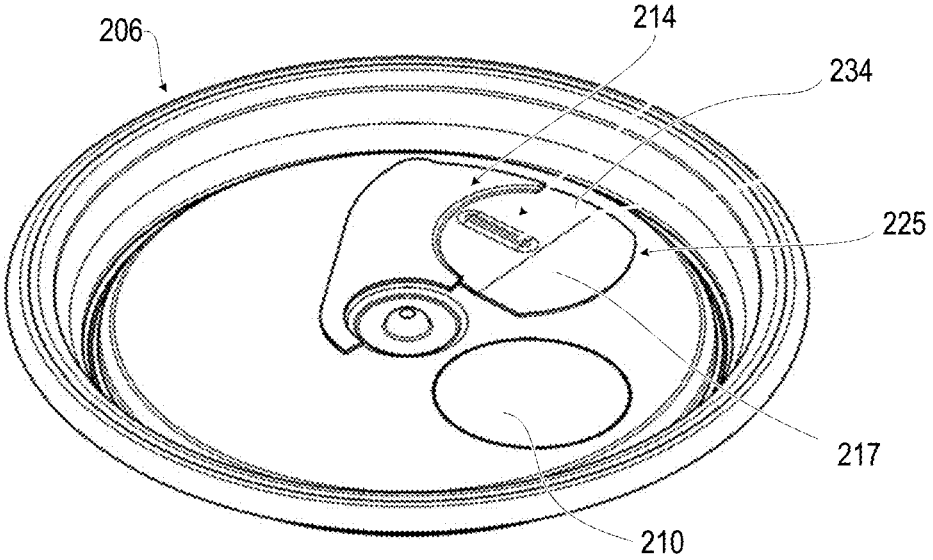
FIG. 18 is a top three-dimensional view of the pop top lid with the top cover of FIG. 16 removed to expose components of a bottom plate of the stay-on tab, according to one or more embodiments.
Figure 19:
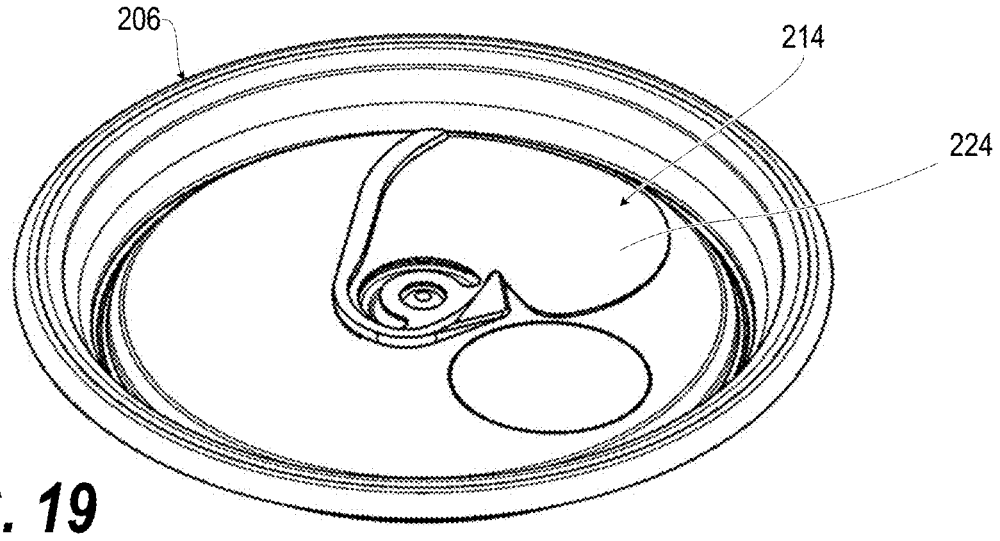
FIG. 19 is a top three-dimensional view of the pop top lid with the top cover of FIG. 16 flipped over to expose underlying components, according to one or more embodiments.
Figure 21:
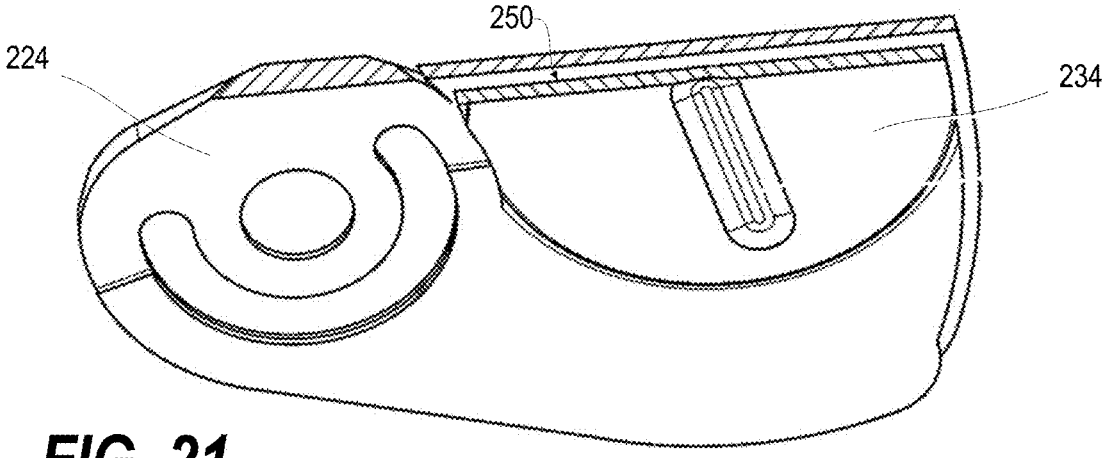
FIG. 21 is bottom three-dimensional view of the stay-on tab cutaway along lines A-A of FIG. 19, according to one or more embodiments.

FIG. 17 is a top view of the pop top lid 206 with the top cover 224 (FIG. 16) removed to expose components of a bottom plate 234 of the stay-on tab 214 including a forward edge flange 217. FIG. 18 is a top three-dimensional view of the pop top lid 206 with the top cover 224 (FIG. 16) removed to expose components of a bottom plate 234 of the stay-on tab 214. FIG. 19 is a top three-dimensional view of the pop top lid 206 with the top cover 224 (FIG. 16) flipped over to expose underlying components. FIG. 20 is bottom three-dimensional view of the top cover 224. A stiffening rib 151 half encircles the rivet 116 from the aperture creation point 122 and extending along a trailing edge of the bottom plate 134. FIG. 21 is bottom three-dimensional view of the stay-on tab 214 cutaway along lines A-A of FIG. 19.

With particular reference to FIG. 18, an inward edge of the scored line 212 is radially spaced from the rivet 216 and corresponds to a tear panel shearing edge 220 extending from an aperture creation point 222 of the top cover 224. Proximate to the aperture creation point 222, a three-quarter annular aperture 226 formed through the top cover 224 and oriented on an opposite side of the rivet 216 away from the aperture creation point 222. The three-quarter annular aperture 226 at a center portion 227 defines a rivet tab 228 that receives rivet 216 and provides a fulcrum-to-load portion of a class 1 lever. A liftable actuator portion 230 at a trailing, counter-clockwise side of top cover 224 extends close to an opposite edge of pop top lid 206 relative to the tear panel 210 and provides a fulcrum-to-effort portion of the class 1 lever. The three-quarter annular aperture 226 enables an initial upward tilt of the liftable actuator portion 230 to be accomplished with minimal force to initiate shearing of the scored line 212. As will discussed herein, with subsequent clockwise rotation, the stay-on tab assembly 214 shears the tear panel 210 away from a circular top surface 218 at the scored line 212 for exposing a circular panel opening 232. As the liftable actuator portion 230 is lifted, the forward edge flange 217 is pushed against the end shell 208, entering into the panel opening 232 and assisting in removal of the tear panel 210. Simultaneously, the stay-on tab assembly 214 captures the removed tear panel 210 as described below. With further rotation, the stay-on tab assembly 214 selectably reseals and unseals the circular panel opening 232.

While the disclosure has been described with reference to exemplary embodiments, it will be understood by those skilled in the art that various changes may be made, and equivalents may be substituted for elements thereof without departing from the scope of the disclosure. In addition, many modifications may be made to adapt a particular system, device, or component thereof to the teachings of the disclosure without departing from the essential scope thereof. Therefore, it is intended that the disclosure is not limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A pop top lid for enclosing a top opening in a cylindrical fluid container, the pop top lid comprising:
- an end shell having an off-center scored line defining a tear panel;
- a stay-on tab assembly; and
- a rivet that attaches the stay-on tab assembly to the end shell for rotation, the stay-on tab assembly comprising:
  - a central portion having a pivot hole that receives the rivet;
  - an aperture point attached to the central portion and rotatably positionable proximate to an inner edge of the scored line;
  - a shearing edge attached to the central portion and radially extending behind the aperture point in a first direction of rotation about the pivot hole; and
  - an actuator portion attached to the central portion opposite to the aperture point, liftable as a first-degree lever to form an aperture at the scored line with the aperture point, and rotatable in the first direction of rotation to insert the shearing edge into the aperture shearing the scored line to remove the tear panel from the end shell.

2. The pop top lid of claim 1, further comprising:
- a bottom plate comprising the aperture point and the shearing edge;
- a top cover comprising the actuator portion and an extending portion that is positioned over top of a portion of the score line to direct a sheared portion of the tear panel downward; and
- a tear panel capturing slot between the bottom plate and the top cover positioned to receive the sheared portion of the tear panel as directed by the extending portion of the top cover.

3. The pop top lid of claim 2, further comprising a capturing pocket downwardly formed within the bottom plate within the tear panel capturing slot, the capturing pocket sized to correspond to receive the tear panel, wherein an undersurface of the tear panel capturing slot comprises a reseal mating surface that is rotationally positionable by the top cover to reseal a panel opening formed in the end shell with removal of the tear panel.

4. The pop top lid of claim 1, further comprising an annular recess formed partially around the rivet hole in the central portion of top cover to define a pivot tab that is attached to the aperture point, the annular recess reducing force required to lift the actuator portion away from the end shell to allow finger actuation.

5. The pop top lid of claim 1, further comprising a flipped-up edge of the actuator portion to facilitate finger actuation of the stay-on tab assembly.

6. The pop top lid of claim 1, wherein the stay-on tab assembly further comprises a pocketed tang comprising a central portion having a pivot hole that receives the rivet and having a top cover and a bottom plate spaced by a gap on a leading edge, the gap communicating with a tear panel capturing pocket, the pocketed tang and extending radially sufficiently to extend over the tear panel.

7. A pop top lid for enclosing a top opening in a cylindrical fluid container, the pop top lid comprising:
- an end shell having an off-center scored line defining a tear panel;

a stay-on tab assembly; and a rivet that attaches the stay-on tab assembly to the end shell for rotation, the stay-on tab assembly comprising:

a pocketed tang comprising a central portion having a pivot hole that receives the rivet and having a top cover and a bottom plate spaced by a gap on a leading edge, the gap communicating with a tear panel capturing pocket, the pocketed tang and extending radially sufficiently to extend over the tear panel, the pocketed tang movable as an actuator portion opposite to the aperture point, liftable as a first-degree lever to form an aperture at the scored line with the aperture point, and rotatable in the first direction of rotation to insert the shearing edge into the aperture shearing the scored line to remove the tear panel from the end shell;

an aperture point attached to the pocketed tang and rotatably positionable proximate to an inner edge of the scored line;

a shearing edge attached to the central portion and radially extending behind the aperture point in a first direction of rotation about the pivot hole; and a flange of the bottom plate that assists in removal of the tear panel, directing the tear panel into the tear panel capturing pocket.

8. The pop top lid of claim 1, wherein the tear panel is circular.

* * * * *